US006929037B2

(12) United States Patent
Nanaji

(10) Patent No.: US 6,929,037 B2
(45) Date of Patent: Aug. 16, 2005

(54) UNDERGROUND STORAGE TANK VAPOR PRESSURE EQUALIZER

(75) Inventor: Seifollah S. Nanaji, Greensboro, NC (US)

(73) Assignee: Gilbarco Inc., Greensboro, NC (US)

( * ) Notice: Subject to any disclaimer, the term of this patent is extended or adjusted under 35 U.S.C. 154(b) by 0 days.

(21) Appl. No.: 10/785,321

(22) Filed: Feb. 24, 2004

(65) Prior Publication Data

US 2004/0163727 A1 Aug. 26, 2004

Related U.S. Application Data

(62) Division of application No. 10/177,943, filed on Jun. 21, 2002, now Pat. No. 6,761,190.

(51) Int. Cl.[7] ..... B65B 1/08

(52) U.S. Cl. ..... 141/67; 141/59; 141/290; 141/198; 141/45

(58) Field of Search ..... 141/67, 64, 59, 141/83, 94, 290, 392, 192, 198, 4, 45; 96/6, 13

(56) References Cited

U.S. PATENT DOCUMENTS

| | | | | |
|---|---|---|---|---|
| 3,369,371 | A | | 2/1968 | Holly et al. |
| RE28,856 | E | * | 6/1976 | Leonard ..... 62/48.2 |
| 4,009,985 | A | | 3/1977 | Hirt ..... 431/5 |
| 4,100,758 | A | * | 7/1978 | Mayer ..... 141/45 |
| 4,311,024 | A | * | 1/1982 | Itoh et al. ..... 62/474 |
| 4,876,653 | A | | 10/1989 | McSpadden et al. ..... 364/479 |
| 5,029,100 | A | | 7/1991 | Young et al. ..... 364/479 |
| 5,038,838 | A | | 8/1991 | Bergamini et al. ..... 141/59 |
| 5,040,577 | A | | 8/1991 | Pope ..... 141/59 |
| 5,067,327 | A | | 11/1991 | Leblanc ..... 62/292 |
| 5,415,196 | A | | 5/1995 | Bryant et al. |
| 5,464,466 | A | | 11/1995 | Nanaji et al. ..... 95/45 |
| RE35,238 | E | | 5/1996 | Pope ..... 141/59 |
| 5,513,680 | A | | 5/1996 | Hilliard, Jr. et al. ..... 141/4 |
| 5,535,818 | A | | 7/1996 | Fujisaki et al. ..... 165/104.33 |
| 5,571,310 | A | | 11/1996 | Nanaji ..... 96/4 |
| 5,626,649 | A | | 5/1997 | Nanaji ..... 96/12 |
| 5,671,785 | A | | 9/1997 | Anderrson ..... 141/59 |
| 5,685,169 | A | * | 11/1997 | Nagamura et al. ..... 62/617 |
| 5,722,242 | A | | 3/1998 | Edelson ..... 62/3.1 |
| 5,755,854 | A | | 5/1998 | Nanaji ..... 96/11 |
| 5,782,275 | A | | 7/1998 | Hartsell, Jr. et al. ..... 141/94 |
| 5,803,136 | A | | 9/1998 | Hartsell, Jr. |
| 5,843,212 | A | | 12/1998 | Nanaji ..... 96/4 |
| 5,860,457 | A | | 1/1999 | Anderrson ..... 141/59 |
| 5,878,792 | A | | 3/1999 | Pettazzoni et al. ..... 141/59 |
| 5,954,080 | A | | 9/1999 | Leatherman ..... 137/14 |
| 5,981,071 | A | | 11/1999 | Cox ..... 428/408 |
| 5,985,002 | A | | 11/1999 | Grantham ..... 96/47 |
| 6,089,311 | A | | 7/2000 | Edelson ..... 165/104.23 |
| 6,131,621 | A | | 10/2000 | Garrard ..... 141/59 |
| 6,174,351 | B1 | | 1/2001 | McDowell et al. ..... 96/4 |
| 6,293,996 | B1 | | 9/2001 | Grantham et al. ..... 95/47 |
| 6,302,165 | B1 | | 10/2001 | Nanaji et al. ..... 141/59 |
| 6,338,336 | B1 | | 1/2002 | Iida ..... 123/674 |

FOREIGN PATENT DOCUMENTS

| | | | |
|---|---|---|---|
| JP | 09014819 | A | * 1/1997 |
| JP | 10300259 | A | * 11/1998 |

* cited by examiner

*Primary Examiner*—Khoa D. Huynh
(74) *Attorney, Agent, or Firm*—Withrow & Terranova, PLLC

(57) ABSTRACT

A vapor pressure equalizer system for reducing the pressure of a storage tank that contains volatile liquid or fuel. A conduit is connected to the storage tank that draws vapors present in the ullage of the storage tank into the conduit. The vapors are circulated through the conduit to cool the vapor and return the vapor to the storage tank. In this manner, the pressure of the storage tank is reduced since the vapors being returned are cooler and smaller in volume than when the vapors entered the conduit. The conduit may be an open system that circulates vapors, or may be a closed system that circulates a cooling media through a radiator in the ullage of the storage tank. An electronic controller controls the operation of the system according to measurements that indicate an overpressure condition or a likelihood of future overpressurization.

34 Claims, 7 Drawing Sheets

UNDERGROUND STORAGE TANK VAPOR PRESSURE EQUALIZER

The present application is a divisional of U.S. patent application Ser. No. 10/177,943, filed Jun. 21, 2002 now U.S. Pat. No. 6,761,190.

FIELD OF THE INVENTION

The present invention relates to providing an apparatus, system and method of reducing and/or eliminating fugitive emissions from a service station underground storage tank.

BACKGROUND OF THE INVENTION

Fuel is prepared to have a certain Reid Vapor Pressure (RVP) before being delivered to an underground storage tank at a service station for later dispensing into a vehicle. RVP is measure of a fuel's volatility at a certain temperature and is a measurement of the rate at which fuel evaporates and emits volatile organic chemicals (VOCs), namely hydrocarbons (HCs). RVP is measured by measuring the pressure of fuel vapor at a temperature of 100 degrees Fahrenheit. The higher the RVP, the greater the tendency of the fuel to vaporize or evaporate. The RVP of fuel can be lowered by reducing the amount of a volatile liquid's most volatile components, such as butane in gasoline fuel for example.

In a service station environment, fuel having a higher RVP, for example 14 pounds per square inch (Psi), is typically delivered during the winter months, whereas fuel having a lower RVP, for example 7 Psi, is typically delivered during the summer months. The reason that it is desirable to deliver fuel to a service station having a lower RVP during the summer months is that this can offset the effect of higher summer temperatures upon the volatility of the fuel, which in turn lowers emissions of VOCs. Emissions of VOCs cause product of ground level ozone and increased exhaust emissions from vehicles. During the winter months, it is desirable to provide fuel having a higher RVP, which ignites easier in colder temperatures.

In service stations employing Stage II vapor recovery systems, the vapor emanating from the vehicle tank during refueling is recovered and is returned to the underground storage tank. During the summer months, the vapor recovered and collected from the vehicle tank has a higher temperature than the underground storage tank. Therefore, the collected vapor shrinks in volume in the underground storage tank due to this temperature differential. It is also less likely for summer fuel, having a lower RVP, to evaporate in the underground storage tank and create vapor growth and therefore volume increase.

During the winter months, the vapor emanating from the vehicle tank collected and returned to the underground storage tank is lower in temperature than the underground storage tank. As a result of this temperature differential, the recovered vapor from the vehicle expands in volume when it enters the underground storage tank. Additionally, the vapor returned to the underground storage tank reacts with the higher RVP fuel in the underground storage tank and vapor growth occurs due to the high volatility of the fuel. This further increases vapor growth in the underground storage tank. If the pressure in the underground storage tank reaches a certain threshold level, a vent to atmosphere is opened to release this excess pressure so that the underground storage tank is not over-pressurized. This release of excess pressure causes vapors or VOCs to be released into the atmosphere thereby causing harm to the environment.

Therefore, a need exists to provide a system and method to keep vapors collected from a vehicle during refueling and resident in the underground storage tank from expanding in the underground storage tank to keep pressure from increasing and releasing VOCs to atmosphere.

SUMMARY OF THE INVENTION

The present invention relates to a vapor pressure equalizer system that cools vapors in the ullage of a volatile liquid storage tank to reduce the pressure inside the volatile liquid storage tank. Reduction of pressure in a volatile liquid storage tank makes it less likely that leaks will occur in the storage tank, and/or any pressure relief valve that is connected to the vent stack running to the ullage of the underground storage tank that is opened to release pressure will be opened and as a result, release volatile vapors into the atmosphere thereby harming the environment.

In a first embodiment, the volatile liquid storage tank holds fuel in an underground storage tank in a service station environment. The system is comprised of a conduit having an inlet port and an outlet port. A valve is connected inline to the conduit, and the valve has a valve inlet and a valve outlet. A pump and heat exchanger are connected inline to the conduit downstream of the valve outlet. An electronic controller is electrically coupled to the valve to control the opening of the valve, and the electronic controller is also electronically coupled to the pump to activate the pump. The electronic controller is adapted to open the valve and activate the pump to draw vapors from the ullage of the storage tank through the inlet port to pass the vapor through the heat exchanger to cool the vapor and return the cooled vapor through the outlet port to the ullage of the storage tank.

In another embodiment, the volatile liquid storage tank holds fuel in an underground storage tank in a service station environment as well. The system is like that of the first embodiment; however, the conduit is not open to the storage tank to draw in vapors from the ullage. Instead the conduit is a closed system and includes a radiator that is placed in the ullage of the storage tank. A cooling media is circulated through the conduit and the radiator, and the radiator cools the vapor in the ullage of the storage tank through heat exchange.

In another embodiment, the volatile liquid storage tank holds fuel in an underground storage tank in a service station environment as well. The system is like that of the first embodiment; however, the inlet and outlet of the conduit are connected to the vent stack instead of the ullage of the storage tank. This may be advantageous if placing additional holes for the inlet and outlet of the conduit to be placed in the underground storage tank is impractical or if the vapor pressure equalizer system is being added to an existing storage tank, which may be underground.

In another embodiment, the volatile liquid storage tank holds fuel in an underground storage tank in a service station environment as well. The conduit and heat exchanger system is placed between a fuel dispenser and the underground storage tank inline with the vapor return passage. As vapor is recovered by the fuel dispenser from a vehicle fuel tank during refueling, the electronic controller controls if the vapor is returned directly to the ullage of the underground storage tank or to the heat exchanger system first. If the electronic controller directs the vapor to the heat exchanger system, the vapors are cooled before being returned to the underground storage tank, thereby reducing the volume of vapors being returned and the temperature of the ullage, which may also reduce the volume of vapors already in the ullage of the underground storage tank.

Those skilled in the art will appreciate the scope of the present invention and realize additional aspects thereof after reading the following detailed description of the preferred embodiments in association with the accompanying drawing figures.

BRIEF DESCRIPTION OF THE DRAWINGS

The accompanying drawing figures incorporated in and forming a part of this specification illustrate several aspects of the invention, and together with the description serve to explain the principles of the invention.

DETAILED DESCRIPTION OF THE INVENTION

The embodiments set forth below represent the necessary information to enable those skilled in the art to practice the invention and illustrate the best mode of practicing the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

The present invention relates to an underground fuel storage tank vapor pressure equalizer system. Underground storage tanks that contain volatile liquids, such as gasoline, may have a temperature differential from that of the outside air. Depending on the characteristics of the liquid, the temperature of the underground storage tank could cause the liquid inside the underground storage tank to evaporate, causing the liquid to transform into a higher volume gaseous form. This may cause an increased pressurization of the storage tank, which may not be desired.

Figure 1:
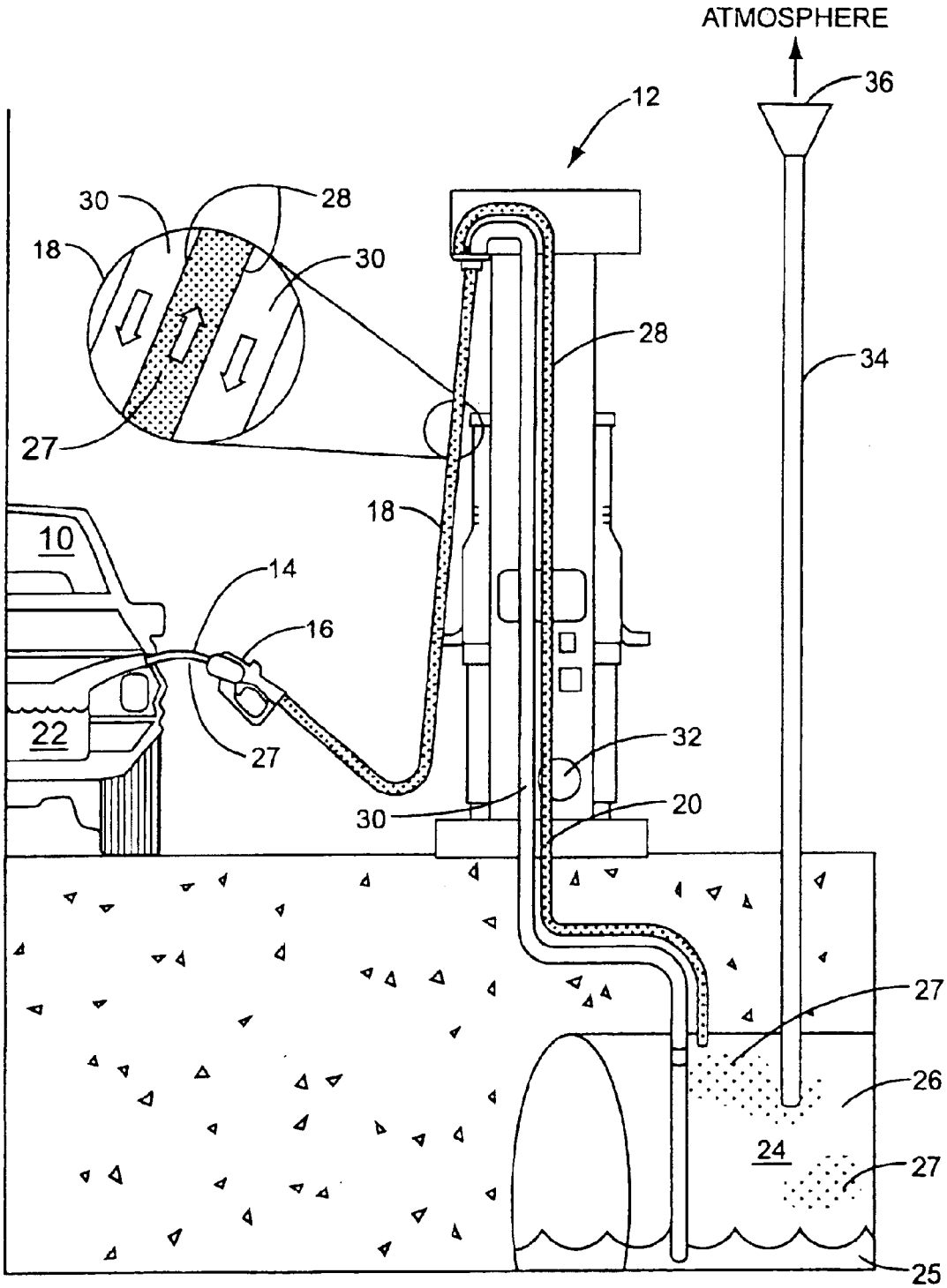
FIG. 1 PRIOR ART
FIG. 1 is a schematic diagram of a Stage II vapor recovery system in the prior art.

Before discussing the particular aspects of the present invention, a description of a typical stage II vapor recovery system in a service station environment is first discussed. FIG. 1 is a typical stage II vapor recovery system in a service station environment. A vehicle 10 is proximate to a fuel dispenser 12 for refueling. The fuel dispenser 12 contains a nozzle 16 that contains a spout 14. The nozzle 16 is connected to a hose 18, which is fluidly coupled to an underground storage tank 24 where liquid gasoline 25 resides. When the customer is dispensing gasoline 25 into his vehicle 10, the customer removes the nozzle 16 from the fuel dispenser 12 and inserts the spout 14 into the vehicle fuel tank 22. The fuel dispenser 12 is then activated, and the liquid gasoline 25 is pumped by a submersible turbine pump (not shown) inside the underground storage tank 24 through a fuel supply conduit 30 and into the hose 18, eventually being delivered through the nozzle 16 and spout 14 into the vehicle fuel tank 22.

The fuel dispenser 12 illustrated in FIG. 1 is also equipped with a stage II vapor recovery system whereby vapors 27 expelled from the vehicle fuel tank 22 are captured as liquid fuel 25 is dispensed into the vehicle fuel tank 22. The hose 18 contains not only a conduit 30 delivery passage for liquid fuel 25 to enter into the vehicle fuel tank 22, but also a vapor return passage 28 whereby vapors 27 captured during fueling of the vehicle fuel tank 22 are returned back to the underground storage tank 24. FIG. 1 contains an exploded view of the hose 18 showing the fuel delivery path 30 and the vapor return passage 28.

When a customer begins a fueling transaction, the fuel dispenser 12 activates a motor (not shown), which in turn activates a vapor pump 32 contained inline to the vapor return passage 28. The vapor pump 32 generates a vacuum inside the vapor return passage 28. The motor may be a constant speed or variable speed motor. When the vapor pump 32 creates a vacuum in the vapor return passage 28, vapor 27 is expelled from the vehicle fuel tank 22 into the spout 14 of the nozzle 16 and into the vapor return passage 28. The vapor 27 then flows back to the ullage area 26 of the underground storage tank 24. The ullage 26 is the portion of the storage tank that does not contain volatile liquid 25. Vapors 27 may be created and reside in the ullage 26 of the underground storage tank 24 if the liquid fuel 25 evaporates into a gaseous form. More information on vapor recovery systems in the service station environment can be found in U.S. Pat. Nos. Re 35,238; 5,040,577; 5,038,838; 5,782,275; 5,671,785; 5,860,457; and 6,131,621, all of which are incorporated herein by reference in their entireties.

A vent stack 34 is also coupled to the underground storage tank 24, and more particularly to the ullage 26 of the underground storage tank 24. The vent stack 34 is coupled to a pressure relief valve 36 whose outlet is open to the atmosphere. If the pressure inside the underground storage tank 24 exceeds a certain threshold pressure, for example 3 column inches of water, the pressure relief valve 36 will open so that vapor 27 in the ullage 26 of the underground storage tank 24, under pressure, will be vented to atmosphere to reduce the pressure inside the underground storage tank 24. Reduction of the pressure inside the underground storage tank 24 is required so that fuel leaks are not prone to occur underground. More information on venting of vapor under pressure in underground storage tanks 24 can be found in U.S. Pat. Nos. 5,464,466; 5,571,310; 5,626,649; 5,755,854; 5,843,212; 5,985,002; and 6,293,996, all of which are incorporated herein by reference in their entireties.

Figure 2:
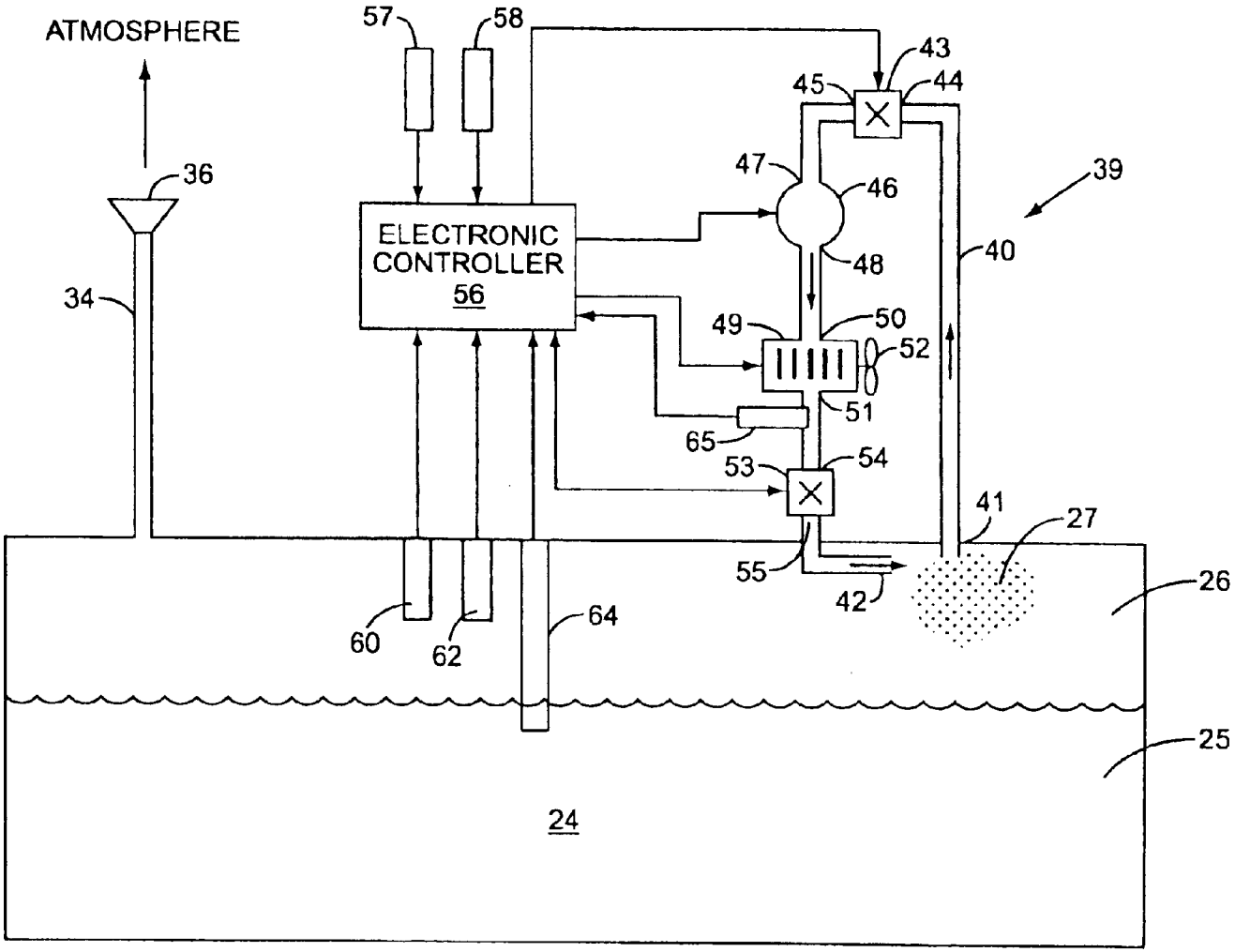
FIG. 2 is a schematic diagram of a vapor cooling system according to one embodiment of the present invention.

FIG. 2 illustrates an underground storage tank pressure equalization system 39 according to one embodiment of the present invention. An underground storage tank 24 is provided that contains a volatile liquid 25, such as gasoline for example. The underground storage tank 24 has an ullage 26, a vent stack 34, and pressure relief valve 36, just as previously described above and illustrated FIG. 1. However, the purpose of the present invention is to employ a system that reduces the pressure of the underground storage tank 24 so that the underground storage tank 24 does not build up sufficient internal pressure to open the pressure relief valve 36 thereby venting the vapor 27 to atmosphere.

The following is a description of how the underground storage tank pressure equalizer system 39 condenses the volume of vapors 27 and returns the reduced volume of vapor 27 back to the underground storage tank 26 to reduce the internal pressure of the underground storage tank 26. When certain criteria are met, discussed later in this application, the vapor 27 in the ullage 26 enters a conduit 40 coupled to the ullage 26. The conduit 40 contains an inlet 41 and an outlet 42. The vapor 27 enters the inlet 41 due to the vacuum created by pump 46 inline to the conduit 40. The pump 46 may be any type of pump that creates a vacuum in conduit 40. For the purposes of this application, the term "inline" to the conduit 40 is used to mean that a device is coupled to the conduit 40 so that the vapor 27 flowing through the conduit 40 enters into the device being referenced.

The pump 46 may also be controlled by a motor (not shown) that is under control of an electronic controller 56 or other circuitry. The electronic controller 56 is a microprocessor, micro-controller or other circuitry that can make decisions as to when the pump 46 should and should not be activated to activate the underground storage tank pressure equalizer system 39 to cause vapors 27 to enter into the inlet 41 of the conduit 40.

Further, in the case of a service station environment, the electronic controller 56 functionality may be incorporated into a site controller and/or point-of-sale system on site, such as the TS-1000® or G-Site® controllers manufactured and sold by Gilbarco Inc. Alternatively, the electronic controller 56 functionality may be incorporated into an underground storage tank monitor, such as the TLS-350 manufactured and sold by Veeder-Root, Inc.

A valve 44 is also opened, under control of the electronic controller 56, so that the vacuum created by the pump 47 causes a vacuum at inlet 41 to draw in the vapor 27 through the conduit 40. The vapor 27 enters the inlet 41 and passes through the inlet side 44 of the valve 43. The vapor 27 passes through the valve 43 and exits through a valve outlet 45. The valve 43 may be any type of valve that opens and closes to allow vapor 27 to flow through, such as a proportional solenoid controlled flow control valve like that described in U.S. Pat. Nos. 4,876,653; 5,029,100; and/or 5,954,080, all of which are incorporated herein by reference in its entireties.

After the vapor 27 exits the valve 43 through the valve outlet 45, the vapor 27 next enters into the pump 46 through a pump inlet 47. The vapor 27 passes through the pump 46 and exits the pump 46 through a pump outlet 48. The pump 46 may be motor controlled and may be any type of pump that is capable of creating a vacuum in the conduit 40. Also, the present invention may employ other means to create a vacuum in the conduit 40 without using a pump 46. For example, the conduit 40 may contain a section having a venturi between a submersible turbine pump (not shown) and the underground storage tank 26 that causes a vacuum to be created inside the conduit 40. The present invention is not limited to any particular type of device or means to create a vacuum in the conduit 40, and the term "pump" is meant to encompass any method, technique or device to create a vacuum in the conduit 40 to draw vapors 27 from the ullage 26 into the inlet 41 of the conduit 40.

Next, after the vapors 27 exit the pump 46, the vapors 27 pass through a heat exchanger 49 by entering into a heat exchanger inlet 50. The heat exchanger 40 may condenses the volume of vapors 27 entering into the heat exchanger 49 by lowering the temperature of the vapors 27. The heat exchanger 49 contains a radiation means, such as a radiator (not shown), that is in thermal contact with the outside to perform heat exchange with the outside air. If the temperature of the outside air is lower than the temperature of the underground storage tank 24, where the vapors 27 reside in the ullage 26, the thermal contact between the heat exchanger 49 and the outside air may be sufficient to cool the vapors 27 and sufficiently reduce their volume before the vapors 27 are returned to the ullage 26. Further, the underground storage tank pressure equalizer system 39 may only operate if there is a sufficient differential between the temperature of the underground storage tank 24 and the outside air so that the vapors 27 can be sufficiently cooled. Further, the effect that the heat exchanger 49 provides may even be accomplished without a separate device. The heat exchanger 49 may also use what is known as "cool-chip" technology, as is disclosed in U.S. Pat. Nos. 5,722,242; 5,981,071; and 6,089,311, all of which are incorporated herein by reference in their entireties.

If the thermal contact and exchange is sufficient between the conduit 40 and the outside air, and if there is a sufficient temperature differential between the underground storage tank 24 and the outside air, simply intaking the vapors 27 through the inlet 41 of the conduit 40 and circulating the vapors 27 through the conduit 40 may cause a sufficient cooling of the vapors 27. The heat exchanger 49 may be nothing more than the conduit 40 in thermal contact with the outside air.

If it is desired for the underground storage tank pressure equalizer system 39 to be able to reduce the temperature of the vapors 27, no matter what the difference between the temperature of the outside air and the underground storage tank 24, the heat exchanger 49 may also include additional means to force a cooling of the vapors 27. For example, the heat exchange 49 may contain a condenser (not shown), under control of the electronic controller 56 or other circuitry, to cool the vapors 27. This may be accomplished by activating the heat exchanger 49 to start a condenser or other means to radiate heat from the vapor 27 to the outside air and thereby cool and reduce the volume of vapor 27. Also, an optional fan 52 may also be used in conjunction with the heat exchanger 29 to further facilitate heat exchange between the heat exchanger 49 and the outside air.

As the vapor 27 exits the heat exchanger 49, the vapors 27 are lower in temperature than when the vapors 27 entered the heat exchanger 49 if the system is operating properly. The vapors 27 next enter into a second valve 54, under control of the electronic controller 56, through the second valve inlet 55. The second valve 54 is optional and serves to prevent vapors 27 in the ullage 26 from entering into the conduit 40 through the outlet 42. When a vacuum is present in the conduit 40, the second valve 54 is opened since vapors 27 will be flowing counter-clockwise from the inlet 41 of the conduit 40 to the outlet 42 of the conduit 40. The vapors 27 next exit the second valve 54 through the second valve outlet 55 and return to the ullage 26 of the underground storage tank 24 through outlet 42.

When the vapors 27 reach the ullage 26, they are are condensed in volume from when these same vapors 27 entered the inlet 41. Since the overall volume of vapors 27 will be reduced as the system operates, this will result in a decrease in pressure in the underground storage tank 24 thereby countering the vapor growth effect that occurs, especially during winter months at a service station.

The electronic controller 56 examines data from several inputs when determining when the underground storage tank pressure equalization system 39 should be activated. Activation means, at a minimum, opening the valve 43 to allow vapors 27 to pass through the heat exchanger 49. Activation may also include activating a pump 46 to create a vacuum in the conduit 40 to draw vapors 27 into the inlet 41, and may also include activation of a condenser or other element of the heat exchanger 49 that must be activated through a stimulus, such as an electronic signal. If the second valve 54 is provided, the electronic controller 56 will also cause the second valve 54 to open to allow cooled vapors 27 to reenter the ullage 26 of the underground storage tank 24.

An ambient or outside temperature sensor 57 and an outside pressure sensor 58 may be input into the electronic controller 56. The ambient temperature sensor 57 measures the temperature of the outside air ($T_{AMBIENT}$), such as the air surrounding the portion of the conduit 40 outside of the underground storage tank 24. The pressure sensor 58 measures the pressure of the outside air ($P_{AMBIENT}$), such as the air surrounding the portion of the conduit 40 outside of the underground storage tank 24.

Also, an underground storage tank temperature sensor 60 and underground storage tank pressure sensor 62 may be provided as inputs into the electronic controller 56. The underground storage tank temperature sensor 60 and underground storage tank pressure sensor 62 measure the temperature in the ullage 26 ($T_{ULLAGE}$) and the pressure of the underground storage tank 24 ($P_{UST}$). Additionally, a liquid temperature sensor 64 is also input into the electronic controller 56. This liquid temperature sensor 64 measures the temperature of the volatile liquid 25 ($T_{FUEL}$) in the underground storage tank 24. Also, a heat exchanger temperature sensor 65 is input into the electronic controller 56 as well. This heat exchanger temperature sensor 65 measures the temperature of the vapors 27 ($T_{HE}$) as the vapors 27 exit through the heat exchanger outlet 51 to determine how efficiently the heat exchanger 49 is cooling the vapors 27.

The electronic controller 56 bases its decisions to in turn control the output devices (i.e. first and second valves 43, 55; vapor pump 46; and heat exchanger 49) in one embodiment of the present invention, based on the readings from the sensors discussed above. The use of the data from these sensors is discussed later in the application and illustrated in flowchart FIG. 4. Before discussing the control aspects of the invention, another embodiment of the configuration of the underground storage tank pressure equalization system 39 is described below and illustrated in FIG. 3.

Figure 3:
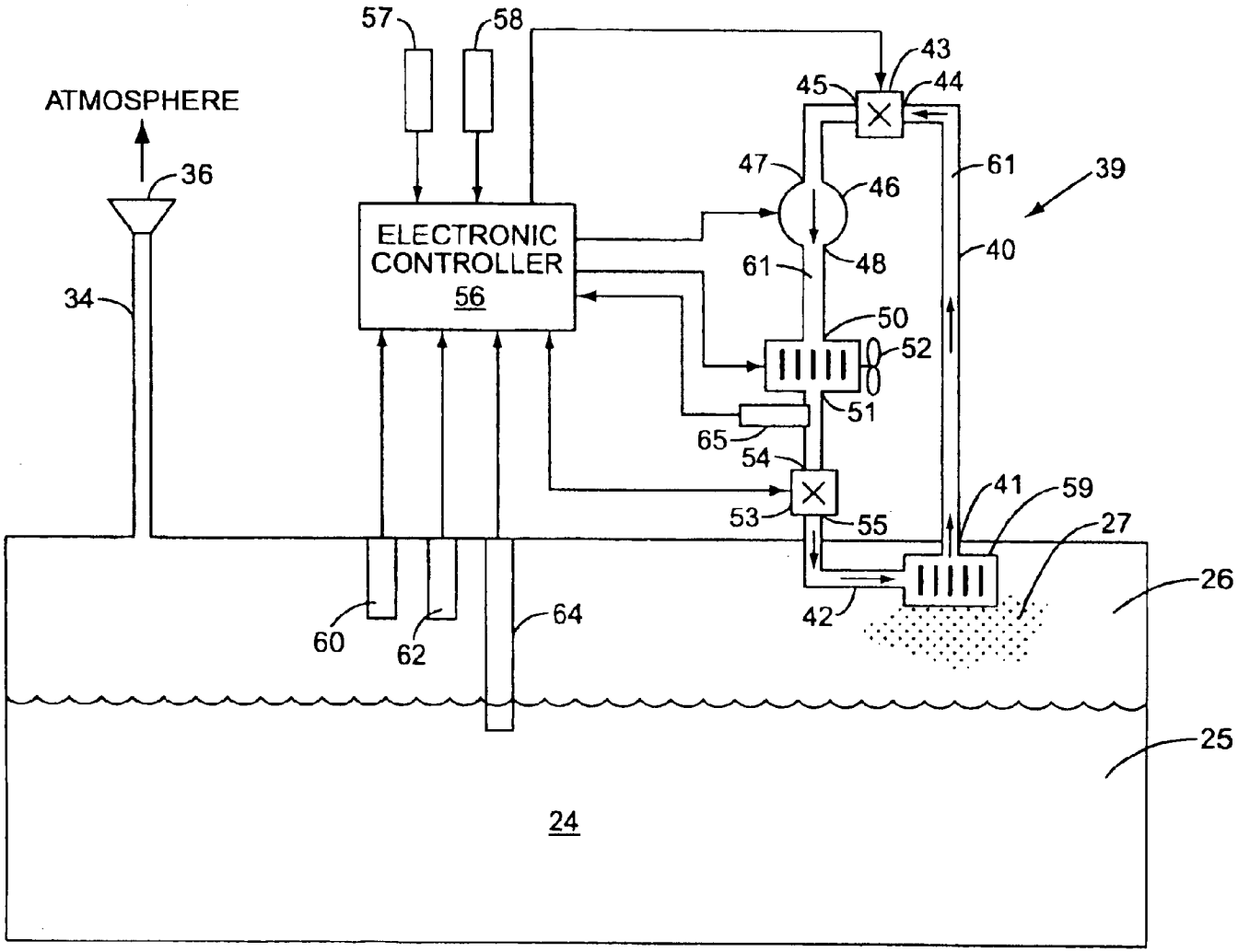
FIG. 3 is schematic diagram of another embodiment of the present invention employing a radiator inside the storage tank.

FIG. 3 illustrates an alternative embodiment of the vapor pressure equalizer system 39. This alternative embodiment is essentially the same as illustrated in FIG. 2; however, there is no inlet 41 and outlet 42 of the conduit 40. Rather, the conduit 40 is a closed loop and is not open to the vapors 27 in the ullage 26 such that the vapors 27 can come into contact with the inside of the conduit 40. A radiator 59 is placed inline with the conduit 40 and is located in the ullage 26 of the underground storage tank 24. In this manner, the vapor pressure equalizer system 39 is a closed system. A cooling media 61 is present inside the conduit 40 that is cooled by the heat exchanger 49, by any of the methods previously described.

When it is desired for the vapor pressure equalizer system 39 to operate, as determined by the electronic controller 56, the electronic controller 56 turns on the vapor pump 46 and opens valves 43 and 55, as previously described for FIG. 2, to allow the cooling media 61, instead of the vapor 27, to circulate through the conduit 40. As the cooling media 61 circulates through the conduit 40, the lower temperature of the cooling media 61 comes into thermal contract with the ullage 26 of the underground storage tank 24 via a radiator 59. The radiator 59 is inside the ullage 26. As the cooling media 61 passes through the radiator 59, the temperature in the ullage 26 surrounding the radiator 59 is cooled, thereby reducing the temperature of the vapors 27.

Figure 4:
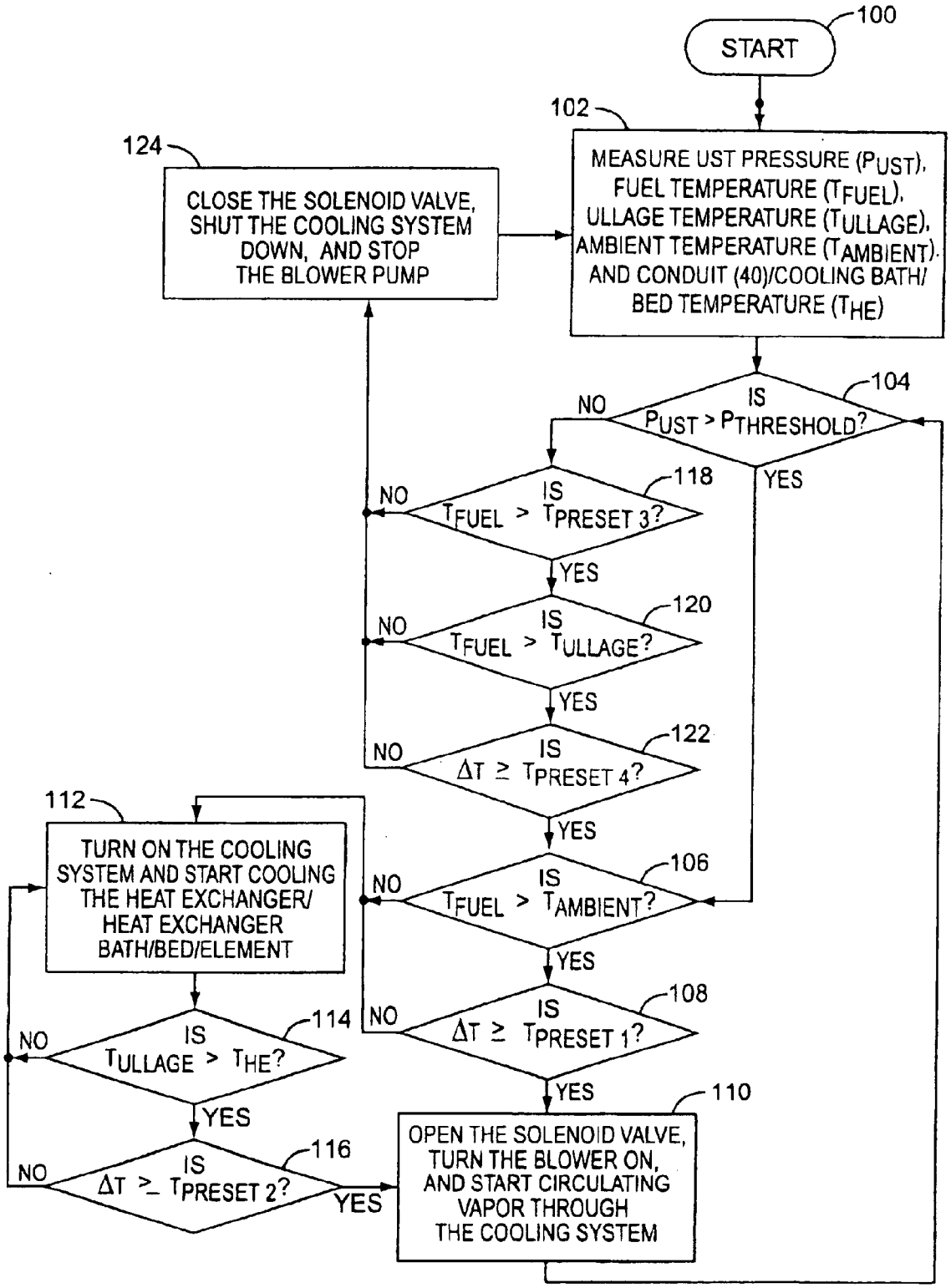
FIG. 4 is a flowchart diagram of the one embodiment of operation of the system illustrated in FIG. 2.

FIG. 4 is a flowchart that describes the operation of the electronic controller 56 for both of the previously described vapor pressure equalizer system 39 embodiments, and as illustrated in FIGS. 2 and 3. Note that the flowchart illustrated in FIG. 4 applies whether the vapors 27 are circulated through the conduit 40 (FIG. 2), or the cooling media 61 is circulated through the conduit 40 (FIG. 3). The process starts (block 100), and the electronic controller 56 takes measurements of the various input devices coupled to the electronic controller 56—$P_{UST}$, $T_{FUEL}$, $T_{ULLAGE}$, $T_{AMBIENT}$, and $T_{HE}$ (block 102).

After the electronic controller 56 measures the readings of the various input sensors in the vapor pressure equalizer system 39, the electronic controller 56 determines if the pressure of the underground storage tank 24 ($P_{UST}$) is greater than a threshold pressure ($P_{THRESHOLD}$) (decision 104). $P_{THRESHOLD}$ may be stored in memory associated with and accessible by the electronic controller 56 and may be user programmable. This inquiry is made, because a pressure inside the underground storage tank 24 ($P_{UST}$) above a certain predefined threshold indicates that vapor 27 expansion has occurred and that the vapor pressure equalizer system 39 is required to operate to bring the pressure of the underground storage tank 24 ($P_{UST}$) down from its current level. If the answer to this inquiry is yes, the electronic controller 56 next determines if the fuel 25 temperature ($T_{FUEL}$) is greater than the ambient temperature ($T_{AMBIENT}$) (decision 106). If yes, this indicates that there is a possibility that the cooling system may not need to be operational, but rather just the heat exchanger 49 turned on to circulate vapor 27 through the conduit 40 since the conduit 40 is in thermal contact with the ambient air.

The electronic controller 56 next determines if the difference in temperature between $T_{FUEL}$ and $T_{AMBIENT}$ is greater or equal to a certain first preset temperature value ($T_{PRESET1}$) (decision 108). $T_{PRESET1}$ may be stored in memory associated with and accessible by the electronic controller 56 and may be user programmable. If the answer to this inquiry is yes, this indicates that the temperature differential between the outside air and the ullage 26 of the underground storage tank 24 is such that the vapor 27 can be sufficiently cooled by circulating the vapors 27 through the conduit 40 without having to activate the heat exchanger 49. Since the conduit 40 is in thermal contact with the outside air, heat exchange between the vapor 27 and the outside temperature ($T_{AMBIENT}$) will occur and will be sufficient to cool the vapor 27 if the outside temperature ($T_{AMBIENT}$) is sufficiently less than the temperature of the fuel 25 ($T_{FUEL}$). The electronic controller 56 simply opens the valve 43 and the second valve 55, if present, and turns on the pump 46 to circulate the vapors 27/cooling media 61 through the conduit 40 to lower the temperature of the vapor 27 (block 110). If a cooling media 61 is used, the cooling media 61 circulates through the radiator 59 to cool the vapors 27 in the ullage 26.

After the electronic controller 56 opens the valve 43, and activates the pump 46 to circulate the vapors 27/cooling media 61 through the conduit 40, the process goes back to decision 104 to determine if the pressure of the underground storage tank 24 ($P_{UST}$) is still greater than a threshold pressure ($P_{THRESHOLD}$). This check is done so that it can be determined if the pressure in the underground storage tank 24 ($P_{UST}$) still needs to be reduced so as to not cause the pressure relief valve 36 to open and vent the vapors 27 to atmosphere. If the answer to decision 104 is yes again, the process continues to decision 106, as previously described.

If either the answer to decision 106 or 108 is no, regarding whether the temperature of the fuel 25 ($T_{FUEL}$) was greater than the ambient temperature ($T_{AMBIENT}$) and if the temperature of the fuel 25 ($T_{FUEL}$) was greater than or equal to a first temperature preset value ($T_{PRESET1}$), the process turns on the heat exchanger 49, but does not open valve 43, and valve 54 if present, nor activate the pump 46. The heat exchanger 49 is activated in this path (block 112) because the temperature of the outside air ($T_{AMBIENT}$) was not sufficiently lower than the temperature of the ullage 26 ($T_{ULLAGE}$) to adequately cool the vapors 27 without the additional assistance of the heat exchanger 49. The heat exchanger 49 is activated and run to provide sufficient cooling inside the conduit 40 before the vapors 27/cooling media 61 are allowed to circulate through the conduit. Next, the electronic controller 56 determines if the temperature of the ullage 26 ($T_{ULLAGE}$) is greater than the temperature of the heat exchanger ($T_{HE}$) (decision 114). If not, the process continues to activate the heat exchanger 49 until the heat exchanger 49 has been activated long enough to provide sufficient cooling of the vapors 27/cooling media 61 (block 112).

If the answer to the inquiry in decision 114 is yes, the electronic controller 56 determines if the difference in temperature between the ullage 26 ($T_{ULLAGE}$) and the temperature of the heat exchanger ($T_{HE}$) is greater than or equal to a second temperature preset value ($T_{PRESET2}$) (decision 116). The second temperature preset value ($T_{PRESET2}$) may be stored in memory associated with and accessible to the electronic controller 56 and may be user programmable. If the answer to this inquiry (decision 116) is no, the process activates the heat exchanger (block 112) as previous described in the preceding paragraph since the heat exchanger 49 has not been activated long enough or is not working sufficiently enough to allow the vapors 27/cooling media 61 to circulate through the conduit 40 to adaquately cool the vapors 27. If this answer this inquiry (decision 116) is yes, this means that the heat exchanger 49 is working sufficiently to cool the vapors 27 to a temperature lower than the temperature of the ullage 26 ($T_{ULLAGE}$). The process will then open the valve 43, activate the pump 46, and open valve 53, if present, to allow the vapors 27/cooling media 61 to circulate through the conduit 61 (block 110).

The process then repeats by determining again if the underground storage tank pressure 24 ($P_{UST}$) is greater than the threshold pressure ($P_{THRESHOLD}$) (decision 104), as previously discussed. As long as the answer to decision 104 is yes, the electronic controller 56 will continue to make the other decisions necessary to determine if the vapor pressure equalizer system 39 should be activated.

If the underground storage tank 24 pressure ($P_{UST}$) is not greater than the threshold pressure ($P_{THRESHOLD}$) (decision 104), the electronic controller 56 next performs a series of decisions to determine (1) if the vapor pressure equalizer system 39 should be deactivated, if currently activated; or (2) should be activated, if certain criteria are present indicating that certain conditions are present making it likely that the fuel 25 in the underground storage tank 24 will react in a manner to evaporate into vapors 27, thereby causing pressure in the underground storage tank 24 to increase. In order for the condition to exist that it is desired for the vapor pressure equalizer system 39 to operate even if the pressure of the underground storage tank 24 ($P_{UST}$) is not greater than the pressure threshold ($P_{THRESHOLD}$), the temperature of the fuel 25 ($T_{FUEL}$) must be greater than a certain preset temperature value ($T_{PRESET3}$), the temperature of the fuel 25 ($T_{FUEL}$) must be greater than the temperature of the ullage 26 ($T_{ULLAGE}$), and the different in temperature between the fuel 25 ($T_{FUEL}$) and the ullage 26 ($T_{ULLAGE}$) must be sufficiently great. A positive answer to all of these preceding factors indicates that it is likely that fuel 25 will evaporate into vapor 27, thereby causing an increase in pressure of the underground storage tank 24 such that it may be desired to activate the vapor pressure equalizer system 39. This process is described in the next paragraph.

The electronic controller 56 first determines if the temperature of the fuel 25 ($T_{FUEL}$) is greater than a third temperature preset value ($T_{PRESET3}$) (decision 118). If no, this indicates that there is not a sufficient likelihood that the fuel 25 will evaporate and thereby cause the creation of more vapors 27 having greater volume to increase the underground storage tank 24 pressure. The process closes the valves 43, 54 (if present) and deactivates the pump 46 and heat exchanger 49 (if currently activated) (block 124), since there is not a need to have the vapor pressure equalizer system 39 active at this time, and returns to block 102 to take new readings from input devices. If the answer to decision 118 is yes, the electronic controller 56 next determines if the temperature of the fuel 25 ($T_{FUEL}$) is greater than the temperature of the ullage 26 ($T_{ULLAGE}$) (decision 120). If not, the process goes to block 124, as previously described above in this paragraph, and for the same reason. If the answer to decision 120 is yes, the electronic controller 56 determines if the difference in the temperature of the fuel 25 ($T_{FUEL}$) and the temperature of the ullage 26 ($T_{ULLAGE}$) is greater or equal to a fourth temperature preset value ($T_{PRESET4}$) (decision 122). If not, this indicates that the vapor pressure equalizer system 39 should not be activated since it is not likely for fuel 25 evaporation, if any, to substantially occur to a point where the pressure of the underground storage tank 24 will quickly increase in the future. The electronic controller 56 deactivates the vapor pressure equalizer system 39 (block 124), as previously described.

If the answer to the inquiry in decision 122 is yes, the process goes to the inquiry at decision 106, just as if the pressure of the underground storage tank 24 ($P_{UST}$) was greater than the pressure threshold ($P_{THRESHOLD}$), even though it was not. The remainder of the process is as described before starting at decision 106.

Figure 5:
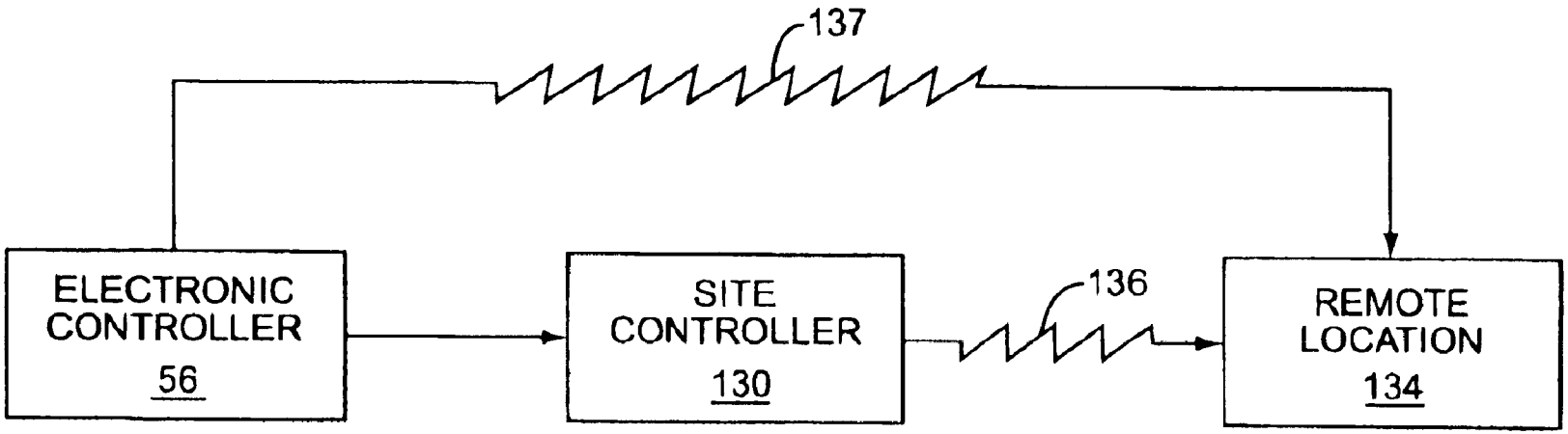
FIG. 5 is a schematic diagram of the communication aspects of the present invention.

FIG. 5 illustrates a block diagram of communication of data gathered by the electronic controller 56 in the vapor pressure equalizer system 39. The electronic controller 56 may be communicatively coupled to a site controller or tank monitor 130, if the vapor temperature pressure equalizer system 39 is used in a service station environment and the electronic controller 56 is not incorporated into the site controller 130. An example of a site controller 130 is the TS-1000™ or the G-Site® manufactured and sold by Gilbarco Inc. An example of a tank monitor 1230 is the TLS-350 manufactured and sold by Veeder-Root, Inc. The electronic controller 56 may communicate any of the data input into the electronic controller 56, such as the $P_{UST}$, $T_{FUEL}$, $T_{ULLAGE}$, $T_{AMBIENT}$, and $T_{HE}$, to the site controller 130.

The site controller 130 may use any of this information for reporting or decision purposes. The site controller 130 may be communicatively coupled to a remote location 134 using a remote communicate line 136, such as public service telephone network (PSTN) or the Internet, for example. Information is communicated by the electronic controller 56 to the site controller 130 can also be communicated from the site controller 130 to a remote location 134 for any type of purpose such as logging, tracking information, or determining if any problems exist in the vapor pressure equalizer system 39. The electronic controller 56 may also be directly communicatively coupled to the remote location 134, via a communication line 137, instead of only being coupled to the site controller 130 in the event that it is desired for the electronic controller 56 to directly communicate information to the remote location 134 without first being communicated through the site controller 130. The communication lines 136, 137 may be wired or may be comprised of a medium used in wireless communications, such as radio-frequency communication.

Figure 6:
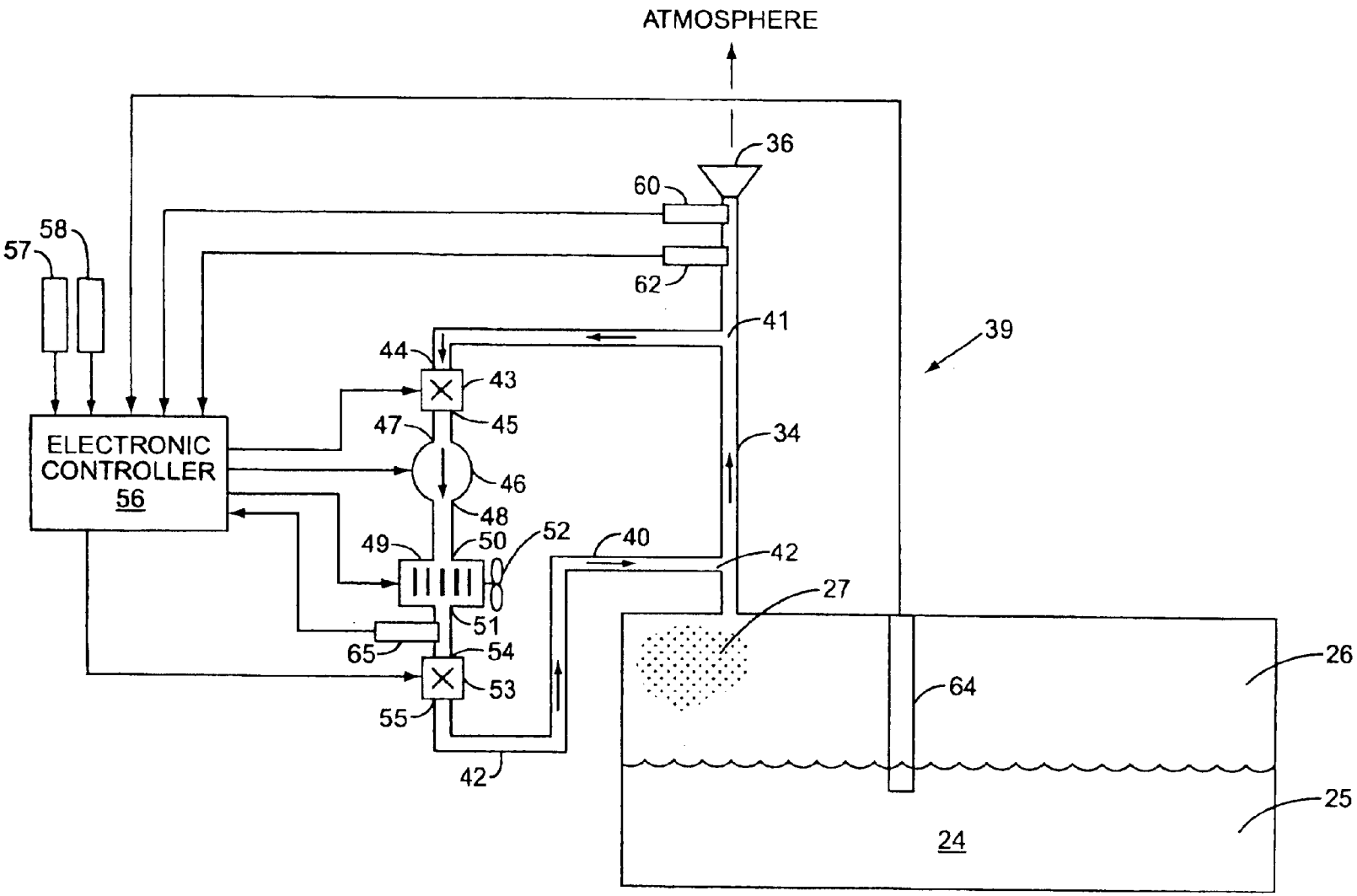
FIG. 6 is a schematic diagram of another embodiment of the present invention like illustrated in FIG. 1, with the conduit connected to the vent stack of the storage tank.

FIG. 6 illustrates another alternative embodiment of the vapor pressure equalizer system 39 of the present invention. The embodiment illustrated in FIG. 6 is like that of the embodiment illustrated in FIG. 2. However, the inlet 41 and outlet 42 of the conduit 40 are coupled inline to the vent stack 34 instead of being coupled in the ullage 26 of the underground storage tank 24. The operation of the embodiment illustrated in FIG. 6 is the same as that illustrated in FIG. 2. It may be advantageous to locate the inlet 41 and outlet 42 of the conduit 40 inline to the vent stack 34 if additional piping cannot be inserted into the underground storage tank 24. For example, the vapor pressure equalizer system 39 in the present invention may be retrofitted or added to previously installed underground storage tank 24. In this manner, it may be easier and less costly to couple the inlet 41 and outlet 42 to the existing vent stack 34 rather than drilling or placing new holes in the underground storage tank 24 that is already underground. Also, for this embodiment illustrated in FIG. 6, the radiator 59 illustrated in FIG. 2 could also be used and placed in the vent stack 34 wherein the conduit 40 is a closed system, as previously described.

Figure 7:
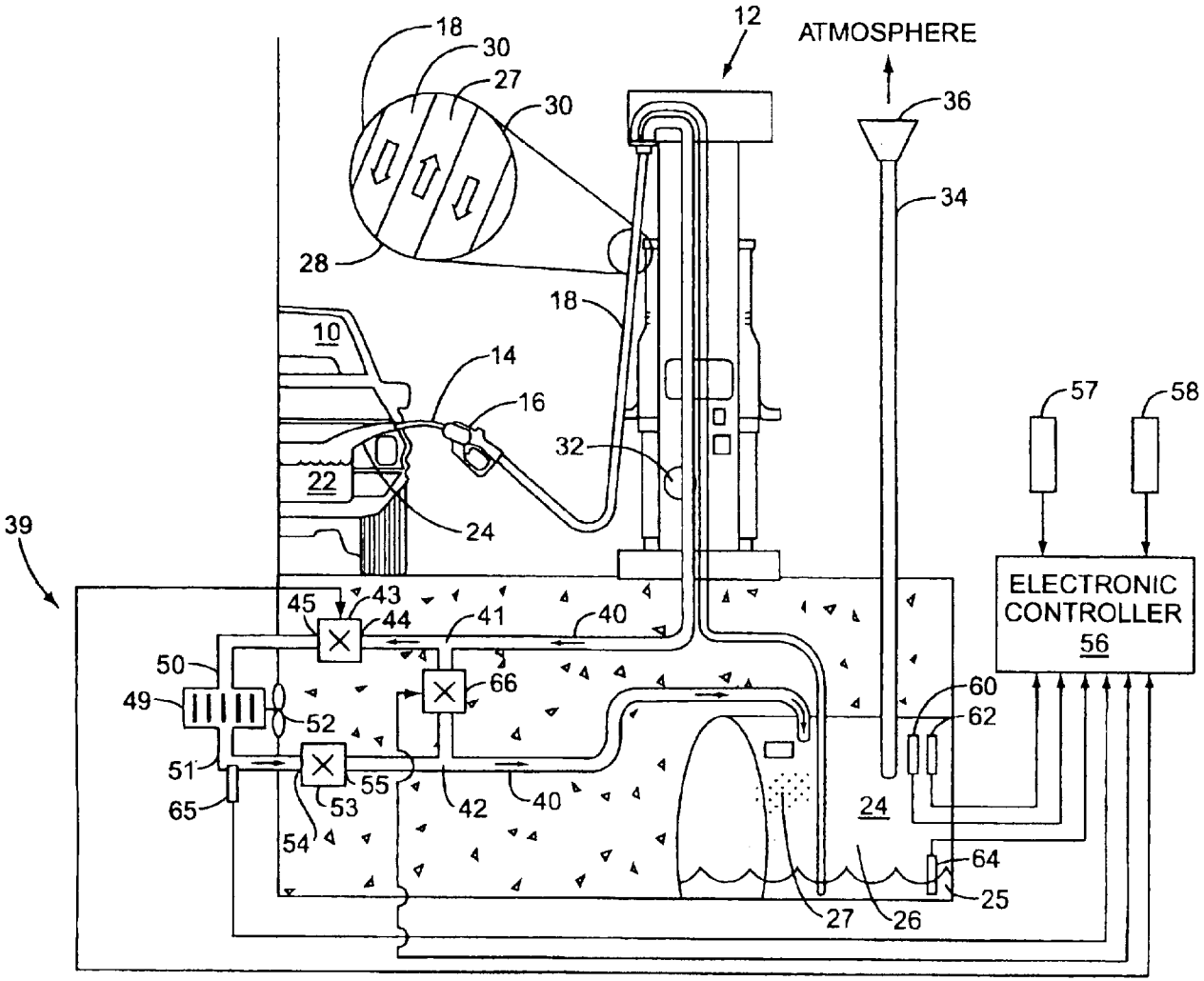
FIG. 7 is a schematic diagram of another embodiment of the present invention whereby vapor is cooled as it is passed by a vapor recovery equipped fuel dispenser to an underground storage tank in a service station environment.

FIG. 7 illustrates another embodiment of the vapor pressure equalizer system 39. The vapor temperature pressure equalizer system 39 is placed inline to the vapor return passage 28. The electronic controller 56 is used, just as previously described above for FIG. 2, with the same input and output control. As vapor 27 is recovered from the vehicle fuel tank 22 and returned through the vapor return passage 28, the vapor 27 can be routed to one of two paths. The first path is when valves 43, 53 are closed, and valve 66 is opened. The recovered vapor 27 will simply return to the ullage 26 of the underground storage tank 24 without be cooled or affected in any manner. However, if the electronic controller 56 determines, using the flowchart process illustrated in FIG. 4, that the vapor pressure equalizer system 39 should be activated to cool the vapors 27, the electronic controller will open valves 43, 53, and close valve 66 so that the recovered vapors 27 will be processed by the heat exchanger 49 and cooled before being returned to the ullage 26 of the underground storage tank 24. The pump 46 is not provided like in that in FIG. 2. The vacuum created by the vapor pump 32 creates the vacuum necessary to force the recovered vapors 27 through the conduit 40.

Those skilled in the art will recognize improvements and modifications to the preferred embodiments of the present invention. The present invention is applicable to any storage tanks that contain volatile liquids, and the present invention is not limited to a service station environment or service station underground storage tank. The terms "fuel" and "volatile liquid" are used interchangeably in this application, and "volatile liquid" includes fuel as on possible type of volatile liquid. The temperature and pressure sensors relating to fuel can also be referred to using the term "volatile liquid" sensors. The embodiments described above are for illustration and enabling purposes, and the techniques and methods applied are equally applicable to any volatile storage system. All such improvements and modifications are considered within the scope of the concepts disclosed herein and the claims that follow.

What is claimed is:

1. A system for reducing the volume of vapor present in the ullage of a storage tank, comprising:

a conduit containing a cooling media;

a radiator located inside the ullage of the storage tank, wherein said radiator is connected inline to said conduit;

a pump and heat exchanger connected inline to said conduit;

an electronic controller that is electrically coupled to said pump to activate said pump, wherein said electronic controller is adapted to activate said pump and circulate said cooling media through said heat exchanger to cool said cooling media and circulate said cooling media through said radiator to cool the vapor in the ullage of the storage tank;

a valve couple inline to an outlet of said heat exchanger, wherein said valve is under control of said electronic controller and said valve is opened to allow said cooling media to circulate through said radiator; and a storage tank pressure sensor that measures the pressure of the storage tank and inputs the storage tank pressure into said electronic controller;

wherein said electronic controller opens said valve and activates said pump if said storage tank pressure is greater than a present threshold.

2. The system of claim 1, wherein said heat exchanger includes a fan to circulate outside air inside said conduit to cool the vapor.

3. The system of claim 1, further comprising a heat exchanger temperature sensor that measures the temperature of the vapor leaving said heat exchanger and inputs the temperature into said electronic controller.

4. The system of claim 1, further comprising an ullage temperature sensor that measures the temperature of the storage tank and inputs the ullage temperature into said electronic controller.

5. The system of claim 1, further comprising an ambient temperature sensor that measures the temperature of the outside air and inputs the ambient temperature into said electronic controller.

6. The system of claim 1, further comprising an ambient pressure sensor that measures the pressure of the outside air and inputs the ambient pressure into the electronic controller.

7. The system of claim 1, wherein said electronic controller additionally activates said heat exchanger if said storage tank pressure is greater than said preset pressure threshold.

8. A system for reducing the volume of vapor present in the ullage of a storage tank, comprising:

a conduit containing a cooling media;

a radiator located inside the ullage of the storage tank, wherein said radiator is connected inline to said conduit;

a pump and heat exchanger connected inline to said conduit;

an electronic controller that is electrically coupled to said pump to activate said pump, wherein said electronic controller is adapted to activate said pump and circulate said cooling media through said heat exchanger to cool said cooling media and circulate said cooling media through said radiator to cool the vapor in the ullage of the storage tank;

a valve coupled inline to an outlet of said heat exchanger, wherein said valve is under control of said electronic controller and said valve is opened to allow said cooling media to circulate through said radiator;

a storage tank pressure sensor that measure the pressure of the storage tank and inputs the storage tank measure into said electronic controller;

a volatile liquid temperature sensor that measures the temperature of the volatile liquid in the storage tank and inputs said volatile liquid temperature into said electronic controller; and an ambient temperature sensor that measures the temperature of the outside air;

wherein said electronic controller also determines if the volatile liquid temperature is greater than the ambient temperature by a preset threshold valve and opens said valve and activates said pump if said volatile liquid to temperature is greater than said preset threshold value.

9. The system of claim 8, wherein said electronic controller additionally activates said heat exchanger.

10. The system of claim 8, wherein said heat exchanger includes a fan to circulate outside air inside said conduit to cool the vapor.

11. The system of claim 8, further comprising a heat exchanger temperature sensor that measures the temperature of the vapor leaving said heat exchanger and inputs the temperature into said electronic controller.

12. The system of claim 8, further comprising an ullage temperature sensor that measures the temperature of the storage tank and inputs the ullage temperature into said electronic controller.

13. The system of claim 8, further comprising an ambient pressure sensor that measures the pressure of the outside air and inputs the ambient pressure into the electronic controller.

14. A system for reducing the volume of vapor present in the ullage of a storage tank, comprising:

a conduit containing a cooling media;

a radiator located inside the ullage of the storage tank, wherein said radiator is connected inline to said conduit;

a pump and heat exchanger connected inline to said conduit;

an electronic controller that is electrically coupled to said pump to activate said pump, wherein said electronic controller is adapted to activate said pump and circulate said cooling media through said heat exchanger to cool said cooling media and circulate said cooling media through said radiator to cool the vapor in the ullage of the storage tank;

a valve coupled inline to an outlet of said heat exchanger, wherein said valve is under control of said electronic controller and said valve is opened to allow said cooling media to circulate through said radiator;

a storage tank pressure sensor that measures the pressure of the storage tank and inputs the storage tank pressure into said electronic controller;

a volatile liquid temperature sensor that measures the temperature of the volatile liquid and inputs said volatile liquid temperature into said controller; and a ullage temperature sensor that measures the temperature of the ullage and inputs said ullage temperature into said electronic controller;

wherein said electronic controller closes said valve and deactivates said pump if said storage tank pressure is less than a pressure threshold, and either said volatile liquid temperature not greater than a preset temperature value, said volatile liquid temperature is not greater than said ullage temperature, or said difference in temperature between said volatile liquid temperature and said ullage temperature is not greater than or equal to a second preset temperature value.

15. The system of claim 14, wherein said heat exchanger includes a fan to circulate outside air inside said conduit to cool the vapor.

16. The system of claim 14, further comprising a heat exchanger temperature sensor that measures the temperature of the vapor leaving said heat exchanger and inputs the temperature into said electronic controller.

17. The system of claim 14, further comprising an ambient pressure sensor that measures the pressure of the outside air and inputs the ambient pressure into the electronic controller.

18. A system for reducing the pressure of a storage tank, comprising:

a storage tank that contains volatile liquid and has an ullage containing vapor;

a conduit containing a cooling media;

a radiator located inside said ullage of said storage tank, wherein said radiator is connected inline to said conduit;

a pump and heat exchanger connected inline to said conduit; and an electronic controller that is electrically coupled to said pump to activate said pump, wherein said electronic controller is adapted to activate said pump and circulate said cooling media through said heat exchanger to cool said cooling media and circulate said cooling media through said radiator to cool said vapor in said ullage of said storage tank;

a valve coupled inline to an outlet of said heat exchanger, wherein said valve is under control of said electronic controller and said valve is opened to allow said cooling media to circulate through said radiator; and a storage tank pressure sensor that measures the pressure of the storage tank and inputs the storage tank pressure into said electronic controller;

wherein said electronic controller opens said valve and activates said pump if said storage tank pressure is greater than a preset pressure threshold.

19. The system of claim 18, wherein said heat exchanger includes a fan to circulate outside air inside said conduit to cool the vapor.

20. The system of claim 18, further comprising a heat exchanger temperature sensor that measures the temperature of said vapor leaving said heat exchanger and inputs the temperature into said electronic controller.

21. The system of claim 18, further comprising an ullage temperature sensor that measures the temperature of said storage tank and inputs the ullage temperature into said electronic controller.

22. The system of claim 18 further comprising an ambient temperature sensor that measures the temperature of the outside air and inputs the ambient temperature into said electronic controller.

23. The system of claim 18 further comprising an ambient pressure sensor that measures the pressure of the outside air and inputs the ambient pressure into the electronic controller.

24. The system of claim 18, wherein said electronic controller additionally activates said heat exchanger if said storage tank pressure is greater than a preset pressure threshold.

25. A system for reducing the pressure of a storage tank, comprising:

a storage tank that contains volatile liquid and has an ullage containing vapor;

a conduit containing a cooling media;

a radiator located inside said ullage of said storage tank, wherein said radiator is connected inline to said conduit;

a pump and heat exchanger connected inline to said conduit; and an electronic controller that is electrically coupled to said pump to activate said pump, wherein said electronic controller is adapted to activate said pump and circulate said cooling media through said heat exchanger to cool said cooling media and circulate said cooling media through said radiator to cool said vapor in said ullage of said storage tanks;

valve coupled inline to an outlet of said heat exchanger, wherein said valve is under control of said electronic controller and said valve is opened to allow said cooling media to circulate through said radiator;

a storage tank pressure sensor that measures the pressure of the storage tank and inputs the storage tank pressure into said electronic controller;

a volatile liquid temperature sensor that measures the temperature of the volatile liquid in said storage tank and inputs said volatile liquid temperature into said electronic controller; and an ambient temperature sensor that measures the temperature of the outside air;

wherein said electronic controller also determines if the volatile liquid temperature is greater than the ambient temperature by a preset temperature value and opens said valve and activates said pump if said volatile liquid temperature is greater than said preset temperature value.

26. The system of claim 25, wherein said electronic controller additionally activates said heat exchanger.

27. The system of claim 25, wherein said beat exchanger includes a fan to circulate outside air inside said conduit to cool the vapor.

28. The system of claim 25, further comprising a heat exchanger temperature sensor that measures the temperature of the vapor leaving said heat exchanger and inputs the temperature into said electronic controller.

29. The system of claim 25, further comprising an ullage temperature sensor that measures the temperature of the storage tank and inputs the ullage temperature into said electronic controller.

30. The system of claim 25, further comprising an ambient pressure sensor that measures the pressure of the outside air and inputs the ambient pressure into the electronic controller.

31. A system for reducing the pressure of a storage tank, comprising:

a storage tank that contains volatile liquid and has an ullage containing vapor;

a conduit containing a cooling media;

a radiator located inside said ullage of said storage tank, wherein said radiator is connected inline to said conduit;

a pump and heat exchanger connected inline to said conduit; and an electronic controller that is electrically coupled to said pump to activate said pump, wherein said electronic controller is adapted to activate said pump and circulate said cooling media through said heat exchanger to cool said cooling media and circulate said cooling media through said radiator to cool said vapor in said ullage of said storage tank;

a valve coupled inline to an outlet of said heat exchanger, wherein said valve is under control of said electronic controller and said valve is opened to allow said cooling media to circulate through said radiator;

storage tank pressure sensor that measures the pressure of the storage tank and inputs the storage tank pressure into said electronic controller;

a volatile liquid temperature sensor that measures the temperature of said volatile liquid and inputs said volatile liquid temperature into said electronic controller; and a ullage temperature sensor that measures the temperature of said ullage and inputs said ullage temperature into said electronic controller;

wherein said electronic controller closes said valve and deactivates said pump if said storage tank pressure is less than a preset pressure threshold, and either said volatile liquid temperature is not greater than a temperature preset value, said volatile liquid temperature is not greater than said ullage temperature, or said difference in temperature between said volatile liquid temperature and said ullage temperature is not greater than or equal to a second temperature preset value.

32. The system of claim 31, wherein said heat exchanger includes a fan to circulate outside air inside said conduit to cool the vapor.

33. The system of claim 31, further comprising a heat exchanger temperature sensor that measures the temperature of the vapor leaving said heat exchanger and inputs the temperature into said electronic controller.

34. The system of claim 31, further comprising an ambient pressure sensor that measures the pressure of the outside air and inputs the ambient pressure into the electronic controller.

* * * * *

UNITED STATES PATENT AND TRADEMARK OFFICE

CERTIFICATE OF CORRECTION

PATENT NO. : 6,929,037 B2
DATED : August 16, 2005
INVENTOR(S) : Seifollah S. Nanaji It is certified that error appears in the above-identified patent and that said Letters Patent is hereby corrected as shown below:

Column 12,
Line 21, change “couple” to -- coupled --.
Line 30, change “present” to -- preset pressure --.

Column 13,
Line 7, change “that measure” to -- that measures --.
Line 8, change “tank measure” to -- tank pressure --.
Line 20, remove “to”.

Column 15,
Line 20, change “tanks” to -- tank --.
Line 21, insert -- a -- before “valve coupled inline”.
Line 43, change “beat” to -- heat --.

Column 16,
Line 24, insert -- a -- before “storage tank pressure sensor”.

Signed and Sealed this

Twenty-fifth Day of October, 2005

JON W. DUDAS
*Director of the United States Patent and Trademark Office*